US006188860B1

(12) United States Patent
Huang

(10) Patent No.: US 6,188,860 B1
(45) Date of Patent: Feb. 13, 2001

(54) METHOD AND ARRANGEMENT FOR DEVELOPING A PLURALITY OF ELECTROSTATIC IMAGES ON A SUBSTRATE

(75) Inventor: Chi-Tai Huang, Miauli (TW)

(73) Assignee: Aetas Technology Corporation, Wilmington, DE (US)

( * ) Notice: Under 35 U.S.C. 154(b), the term of this patent shall be extended for 0 days.

(21) Appl. No.: 09/335,658

(22) Filed: Jun. 18, 1999

(51) Int. Cl.[7] ..... G03G 15/09
(52) U.S. Cl. ..... 399/267; 399/159; 399/231
(58) Field of Search ..... 399/159, 162, 399/164, 223, 231, 267, 270

(56) References Cited

U.S. PATENT DOCUMENTS

| | | | | |
|---|---|---|---|---|
| 4,357,103 | * | 11/1982 | Kroll | 399/267 |
| 4,378,754 | * | 4/1983 | Rasekhi et al. | 399/267 X |
| 5,030,996 | * | 7/1991 | Tajima et al. | 399/270 X |
| 5,276,487 | | 1/1994 | Akinaga et al. . | |
| 5,418,097 | | 5/1995 | Furuya et al. . | |
| 5,434,651 | * | 7/1995 | Aizawa et al. | 399/267 X |
| 5,532,801 | | 7/1996 | Mizoguchi . | |
| 5,543,901 | * | 8/1996 | Yamamoto et al. | 399/267 |
| 5,640,648 | * | 6/1997 | Komakine et al. | 399/267 X |
| 5,848,337 | * | 12/1998 | Liu et al. | 399/231 |
| 5,890,038 | | 3/1999 | Ohsawa et al. . | |
| 5,926,676 | * | 7/1999 | Snelling et al. | 399/267 |
| 5,933,683 | * | 8/1999 | Snelling et al. | 399/267 X |
| 5,978,634 | * | 11/1999 | Sato et al. | 399/267 X |

* cited by examiner

*Primary Examiner*—Sandra Brase
(74) *Attorney, Agent, or Firm*—BakerBotts, LLP

(57) ABSTRACT

In the particular embodiment disclosed in the specification, an electrostatic image forming arrangement includes a photoreceptor in the form of a continuous belt which is moved past four development stations each containing a different colored toner which incorporates ferromagnetic material. At each development station a developer roll conveys toner in closely spaced relation to the surface of the photoreceptor and a DC-biased AC voltage is applied to the developer roll to cause the toner to be transferred to an electrostatic image on the photoreceptor. A magnet member mounted on the opposite side of the photoreceptor produces a magnetic field which holds toner on the image-receiving surface permitting a greater range of variation for the DC-biased AC toner transfer voltage.

16 Claims, 4 Drawing Sheets

METHOD AND ARRANGEMENT FOR DEVELOPING A PLURALITY OF ELECTROSTATIC IMAGES ON A SUBSTRATE

BACKGROUND OF THE INVENTION

This invention relates to methods and arrangements for development of two or more electrostatic images in succession on a substrate.

In some electrostatic image development systems such as multicolor imaging systems, the surface of an electrophotographic member is provided with a uniform charge and subsequently exposed to form a first electrostatic image which is then developed with one developer, and the same surface is again charged and exposed for a different image which is then developed with a different developer, and the same process may be repeated for still another image developed by a still different developer before the combined images are transferred to a permanent support member.

In image forming systems of this type, there is a problem resulting from undesired removal of toner from the surface of the photoreceptor which has been deposited by development of a previous image when a subsequent image is being developed. This not only degrades the first image, but also contaminates the developer used to develop the later image.

Several different approaches have been attempted to overcome this problem. For example, U.S. Pat. No. 5,176,487 discloses an arrangement in which the first image is developed by a one-component magnetic developer and the second image is developed by a two-component developer with a non-magnetic toner and a magnetic carrier which is the same as the one component developer used to develop the first image. Consequently, any of the one-component developer removed from the first image during the second development merely acts as a carrier in the second developer unit and does not contaminate the second developer.

In U.S. Pat. No. 5,418,097 noncontact development of successive color images is effected by imposing an AC voltage with a DC bias between a member bearing an electrostatic image and a developer roll spaced from the image-bearing member and carrying the toner to be applied to the image, causing toner to jump to the electrostatic image on the image-bearing member. According to that patent, the time during which toner is attracted from the developer roll to the image during each AC cycle should be greater than the time during which toner might be attracted from the electrostatic image to the developer roll.

U.S. Pat. No. 5,532,801 discloses a multi-image developing arrangement using an AC toner transfer voltage with a DC bias applied between the developer roll and the image-bearing member in which the rate of change of the AC voltage is reduced during the time when the AC voltage changes from the toner transfer voltage to a voltage at which toner will be returned to the developer roll and is increased during the time when the toner transfer voltage is changing from the toner return voltage to the toner transfer voltage. This reduces the tendency of toner on the image-bearing member to return to the developer roll.

U.S. Pat. No. 5,890,038 describes a two-color image forming apparatus in which the toner particles in the developer unit which forms a first toner image on an image-bearing member spaced from the developer roll are larger than those of the developer used to form a second image on the image-bearing member. As a result, the electrostatic force with which the first toner particles are retained on the developer roll of the second developer unit is lower than the force with which the particles of the second toner are retained on the developer roll of that developing unit, permitting the first toner particles in that unit to be removed from the developer roll.

Such prior art attempts to avoid the problem of removal and mixing of toner from one developed image during development of a second image on the same substrate involve complex procedures or structural arrangements and in some cases require different types of developers for the different images.

SUMMARY OF THE INVENTION

Accordingly, it is an object of the present invention to provide a method and arrangement for developing a plurality of electrostatic images on a substrate which overcomes disadvantages of the prior art.

Another object of the invention is to provide a method and arrangement for developing a plurality of images in succession on a substrate with different color developers which avoids disadvantages of the prior art.

A further object of the invention is to provide a simple and effective method and arrangement for successive development of different color images on a substrate without requiring developers having different types of constituents.

These and other objects of the invention are attained by providing an imaging arrangement for forming a plurality of images on a substrate including a plurality of successive electrostatic image development stations in which the developers are ferromagnetic toners and an arrangement for generating a magnetic field to retain previously deposited toner on the substrate during development of a subsequent electrostatic image on the same substrate. By providing ferromagnetic toners and a magnetic toner retaining arrangement, the operating range of a DC biased AC toner transfer voltage imposed between each developing unit and the substrate can be significantly increased without causing removal of previously deposited toner particles from the substrate.

BRIEF DESCRIPTION OF THE DRAWINGS

Further objects and advantages of the invention will be apparent from a reading of the following description in conjunction with the accompany drawings, in which.

DESCRIPTION OF PREFERRED EMBODIMENTS

Figure 1:
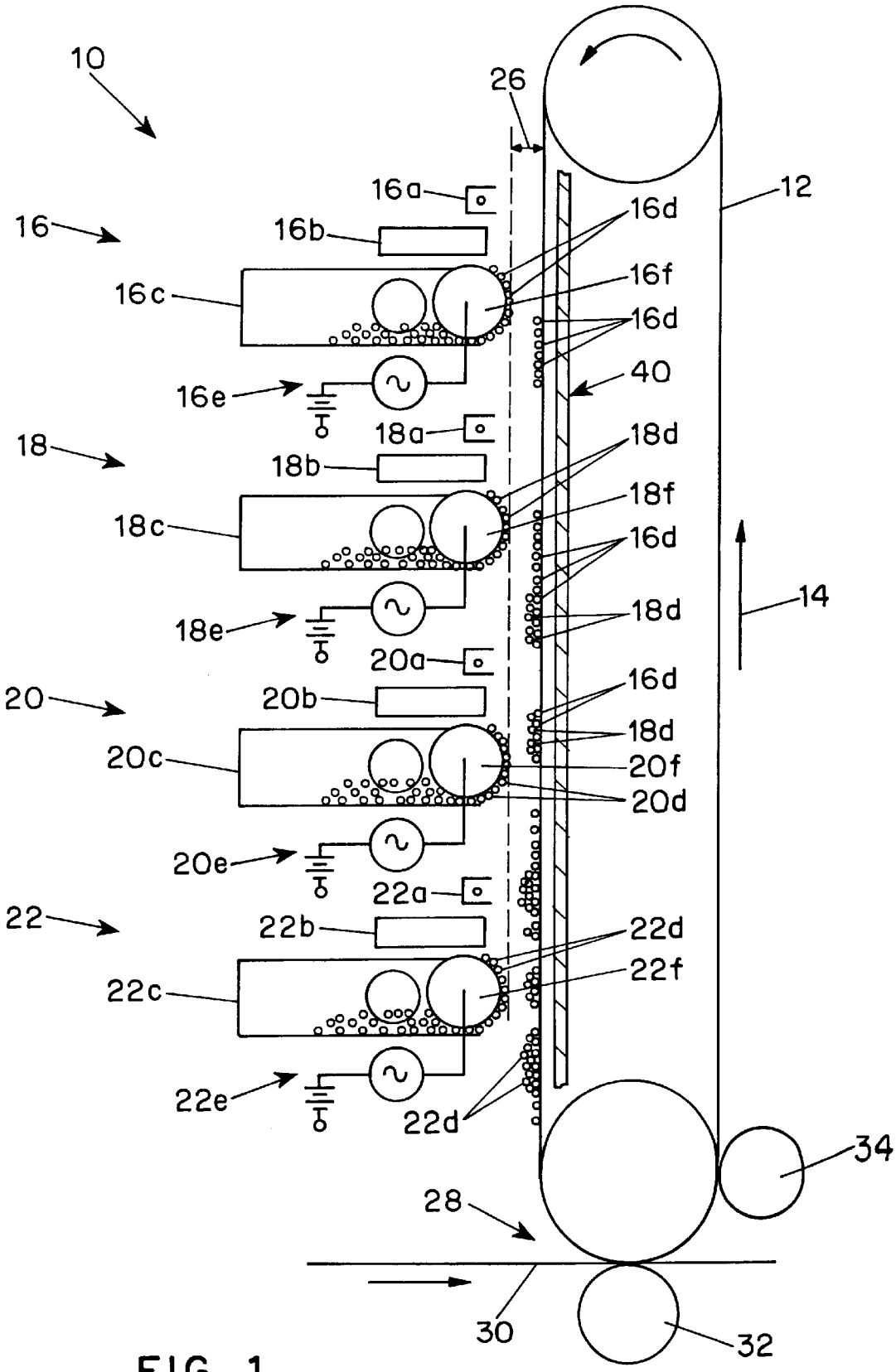
FIG. 1 is a schematic illustration showing a representative embodiment of a multicolor image formation system using DC biased AC development in accordance with the invention.

In the representative embodiment of the invention shown in FIG. 1, a multicolor imaging system 10 includes a belt shaped image support member 12, such as a conventional electrophotographic photoreceptor, which is conveyed in an endless loop path in the direction indicated by the arrow 14 past four successive imaging stations 16, 18, 20 and 22. Each imaging station includes a charging unit 16*a*–22*a* and an image exposure unit 16*b*–22*b* followed by a developing unit 16*c*–22*c*. At each imaging station, a uniform charge is applied to the photoreceptor 12 by a charging unit 16*a*–22*a* and the photoreceptor 12 is then exposed to image information by an exposure unit 16*b*–22*b*, causing an electrostatic image to be produced on the surface of the photoreceptor. The charging units 16*a*–22*a* may be conventional corona charging devices or the like and the image exposure units 16*b*–22*b* may be conventional LED or laser scanning units. In each developing unit 16*c*–22*c* the developer has a color conforming to the color requirement of the image information generated by the corresponding exposure unit and, in the illustrated embodiment, the developing units 16*c*–22*c* contained four different color toners, 16*d*–22*d*, respectively, which may, for example, have conventional multicolor image colors such as, yellow, magenta, cyan and black.

In conventional multicolor image development arrangements of this type in which successive images are applied to a photoreceptor, noncontact development is used to avoid removal of a developed image which could result from physical contact by a developer applying member in a subsequent developer unit. For this purpose, a DC biased AC potential from a potential source 16*e*–22*e* is applied to a corresponding developer roll 16*f*–22*f* in each developing unit so as to produce an electrostatic force causing toner 16*d*–22*d* carried by the developer roll to jump across a small gap 26 between the developer roll 16*e*–22*e* and the photoreceptor 12. In FIG. 1 the relative dimension of the gap 26, shown by a dash line spaced from the photoreceptor 12, as well as the size of the toner particles 16*d*–22*d* is exaggerated for convenience of illustration. The actual spacing 26 is on the order of 300 to 500 microns and the size of the toner particles is on the order of 5 to 25 microns. After all of the toner images have been formed on the surface of the photoreceptor 12, the composite color image is transferred at a transfer station 28 to a substrate 30 as it passes through a nip between the photoreceptor 12 and a transfer roll 32. Thereafter, the surface of the photoreceptor is cleaned at a cleaning station 34.

Figure 2:
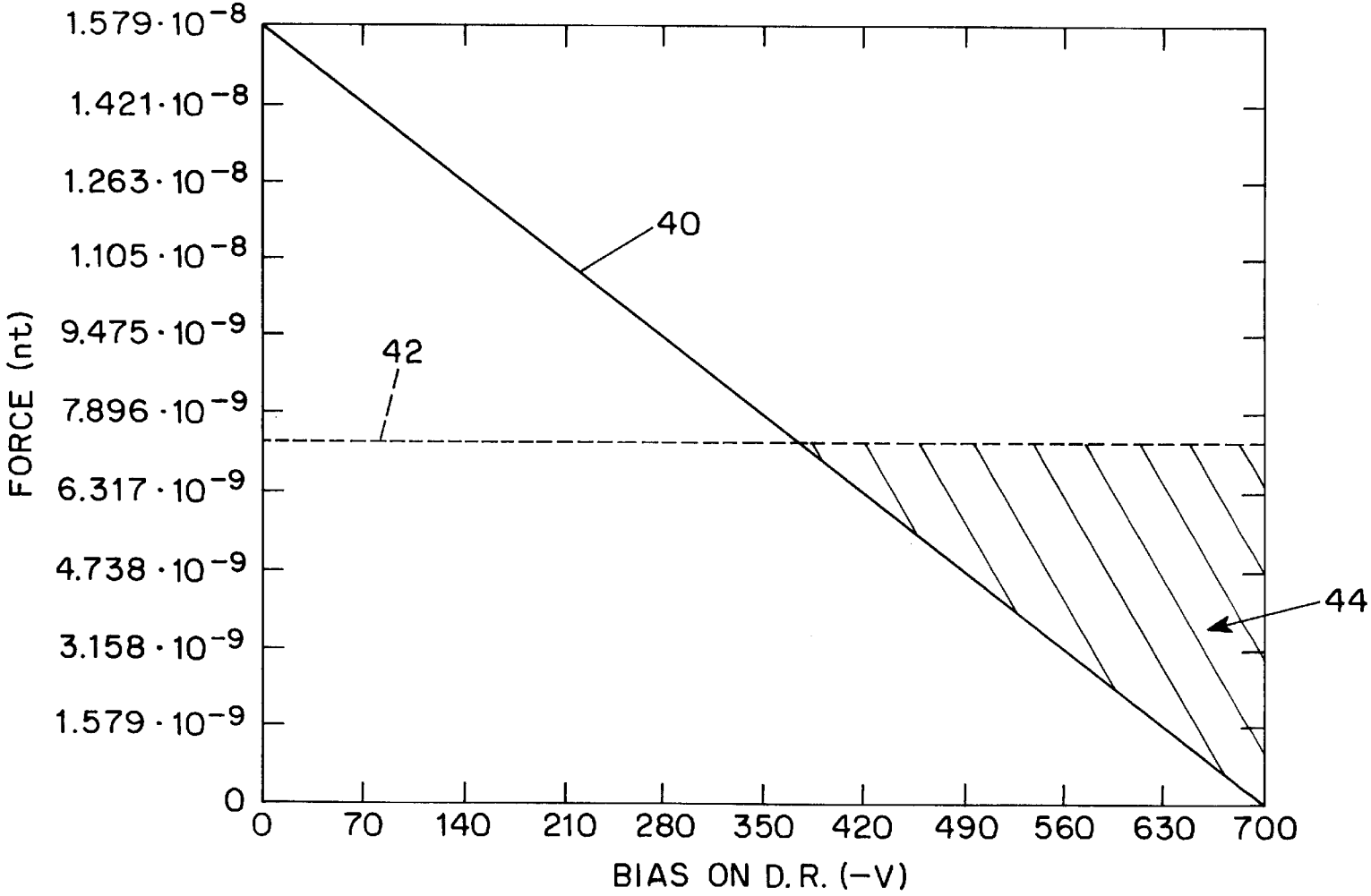
FIG. 2 is a graphical representation illustrating the relation between developer roll bias and electrostatic force on toner particles and the toner image retaining force in a conventional image developing arrangement.

In such conventional arrangements, a careful balance must be maintained between the electric field produced by the voltage applied from the potential sources 16*e*–22*e* to the developer roll 16*d*–22*d*, the surface potential of the photoreceptor 12 resulting from the charge applied to the surface by the charging device 16*a*–22*a*, the spacing 26 between the surface of the developer rolls and the photoreceptor, and the charge retained by the previously deposited toner particles 16*d*–20*d* on that surface in order to assure toner transfer to an electrostatic image vehicle preventing subsequent developing units from removing toner particles previously deposited on the surface of the photoreceptor. FIG. 2 illustrates the relation between the bias on the developer roll 16*e*–22*e* and the forces on the previously deposited toner particles in a conventional arrangement in which the gap 26 between the developer roll and the photoreceptor 12 is 400 microns, the voltage on the surface of the photoreceptor resulting from charging by the charging unit 16*a*–22*a* is −700 volts, the density of toner 16*d*–20*d* deposited by a previous development is 0.36 g/cm$^2$, the diameter of toner particles is 10 microns and the charge per unit mass on the toner particles on the developer roll 16*f*–22*f* is −6 microcoulombs per gram, with the mass of each toner particle being $1.88\times10^{-10}$ grams, the charge on each toner particle being $1.128\times10^{-15}$ coulombs and the charge on the deposited toner particles after recharging of the photoreceptor being $9.024\times10^{-15}$ coulombs.

Under the above described conditions, a toner particle 16*d*–22*d* which has been deposited on the photoreceptor 12 is subjected to two different forces during subsequent development. The electrostatic field force resulting from the AC voltage applied to a subsequent developer roll 18*e*–22*e* tends to draw the deposited toner particles 16*d*–20*d* away from the surface of the photoreceptor while the image retaining force tends to hold the deposited toner particles 16*d*–20*d* on the photoreceptor. FIG. 2 represents the variation in the electrostatic force tending to draw toner particles away from the photoreceptor by a diagonal line 40, which shows that that force increases with decreasing bias on the developer roll, and represents the force tending to retain the toner particles 16*d*–20*d* on the surface of the photoreceptor 12 by a horizontal line 42 which shows that that force does not change with changing bias on the developer roll. A triangular section 44 between the lines 30 and 32 of the graphical illustration in FIG. 2 shows the region of acceptable operating conditions, i.e. those assuring proper development while causing the previously deposited toner 16*d* to be retained on the photoreceptor surface, based on the parameters set forth above.

Figure 3:
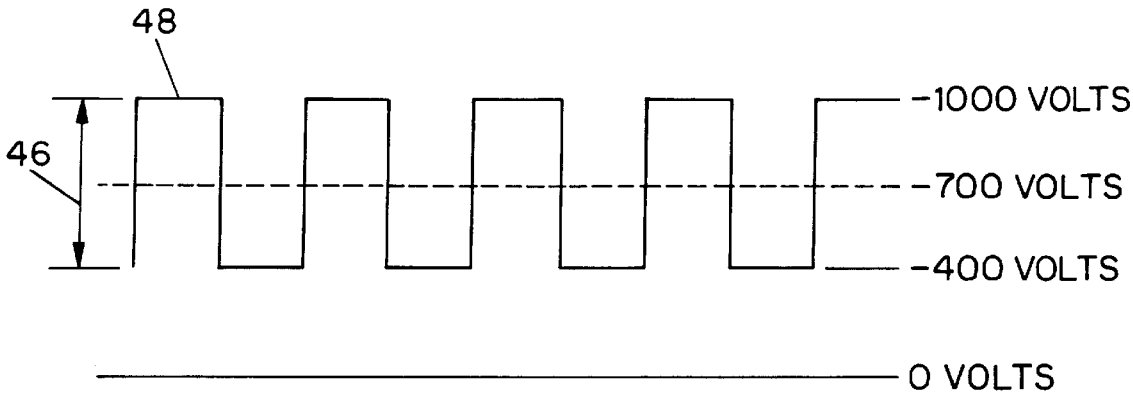
FIG. 3 is a graphical representation illustrating the permissible voltage range of a DC biased AC toner transfer voltage with the conventional arrangement which is the subject of FIG. 2.

FIG. 3 illustrates the permissible range 46 for a DC-biased AC voltage waveform 48 applied by the voltage source 16*e*–22*e* to the development roll 16*d*–22*d* of FIG. 1 in a conventional system having the parameters described in connection with FIG. 2, showing that the AC voltage must be limited to a peak-to-peak range of 600 volts centered on the −700 volt surface potential of the photoreceptor 12. The range represented by these values may have to be reduced to allow for variations in the parameters such as the spacing between the development roll and the photoreceptor, the size of the toner particles and the like.

Figure 5:
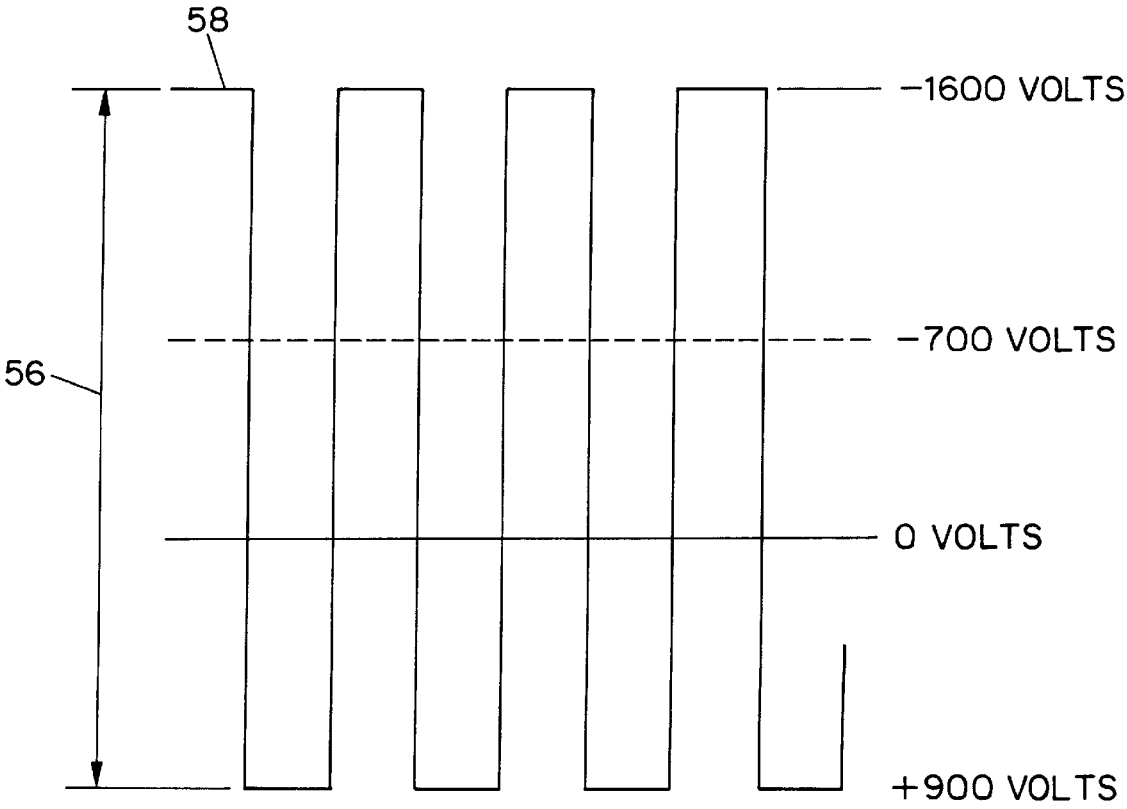
FIG. 5 is a graphical illustration similar to FIG. 3 showing the relation between the developer roll bias and the electrostatic force on toner particles as well as the force retaining the toner particles deposited on the image substrate in an image development arrangement according to the invention.
Figure 4:
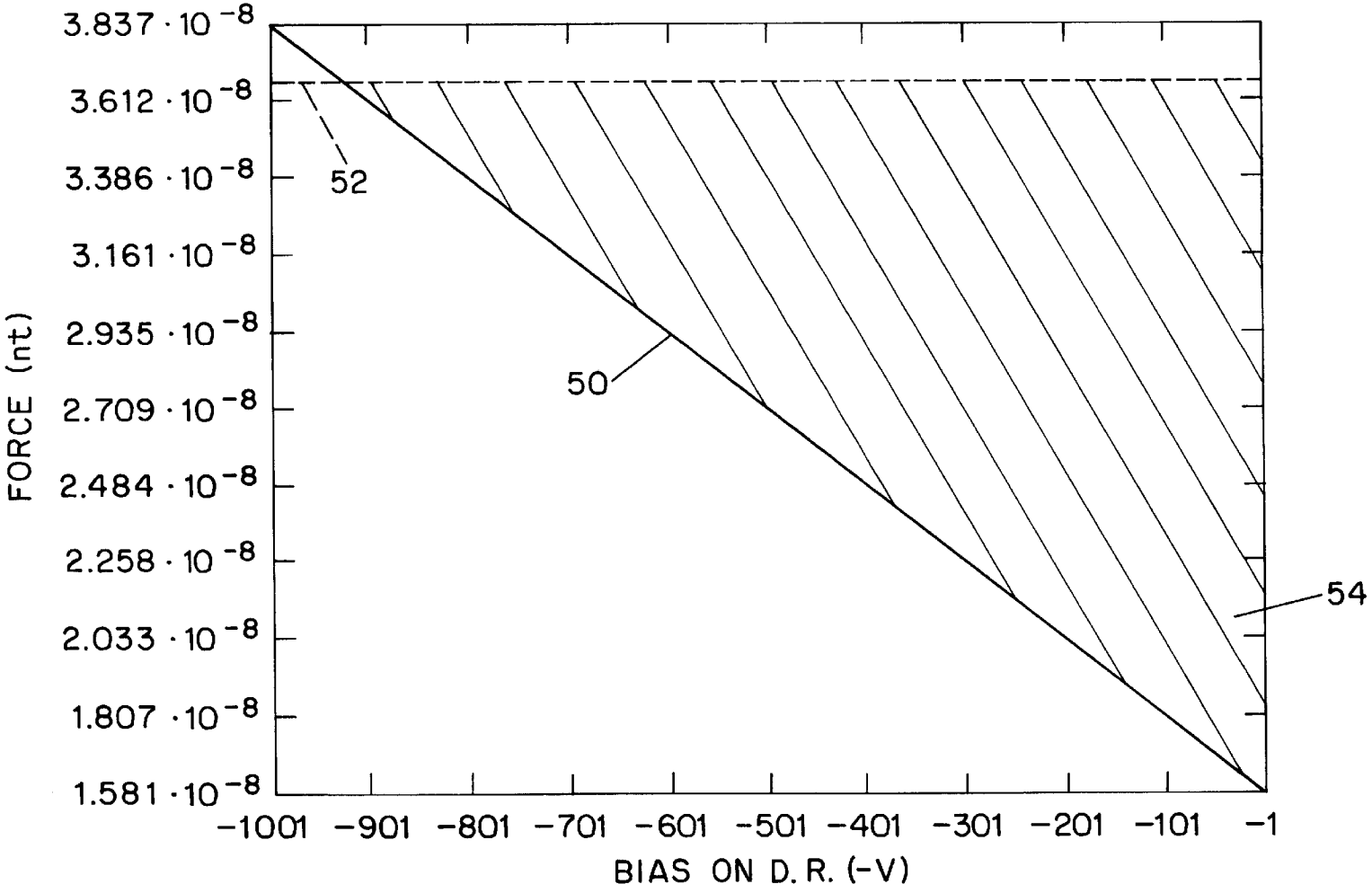
FIG. 4 is a graphical illustration similar to FIG. 2 showing the permissible voltage range of a DC biased AC toner transfer voltage in an image forming arrangement according to the invention.

In order to provide a substantial increase in the operating range of the DC-biased AC voltage applied to the developer roll in accordance with the invention, the image forming apparatus shown in FIG. 1 contains a magnetic field generating arrangement such as a magnet plate 40, which may, for example, be a continuous sheet of permanent magnet material, disposed on the opposite side of the photoreceptor 12 from the image forming surface, and the toner particles 16*d*–22*d* in all of the developing units 16*c*–22*c* are formulated to contain a ferromagnetic material. As a result, the force tending to retain deposited toner particles on the surface of the photoreceptor 12 is substantially increased so that a significantly greater range of the AC voltage applied to the developer rolls is possible without causing removal of previously deposited toner. FIG. 4 is a graph similar to that of FIG. 2 based on the same parameters described above with respect to FIG. 2 but with a magnetic field generating arrangement adjacent to the photoreceptor 12, showing the relation between the bias on the developer roll and electrostatic force on the toner particles which is represented by a diagonal line 50 and the force tending to retain the toner particles on the surface of the photoreceptor which is represented by a horizontal dotted line 52. In this case, there is a much larger region 54 of acceptable operation in comparison with that of FIG. 2. FIG. 5 illustrates the corresponding permissible AC voltage range 56 for an AC voltage waveform 58, extending from +900 volts to −1600 volts, applied to the developer roll 16*e*–22*e*. As a result, a much wider range of operating conditions can be provided for a multicolor image forming system without concern that deposited developer particles of one color will be removed during subsequent development steps or will contaminate the developers of subsequent developing units.

It will be understood that the magnetic field generating arrangement used in the invention may consist of a plurality of separate magnet units each associated with a corresponding development unit rather than a single magnet plate, and that one or more electromagnetic field generating arrangements may be used if desired in place of one or more permanent magnet members. Moreover, the type and proportion of the ferromagnetic constituent of the toner particles may vary as required to suit the toner formulation. It is only necessary that the amount is sufficient to cause the toner particles to be reliably retained on the surface of the photoreceptor throughout any subsequent development operations. It will also be apparent that the electrostatic images to be developed may be produced in other ways than by electrophotography, for example, by selective deposition of charges in an image-forming manner on the surface of an insulating layer.

Although the invention has been described herein with reference to the specific embodiments, many modifications and variations therein will readily occur to those skilled in the art. Accordingly, all such variations and modifications are included within the intended scope of the invention.

I claim:

1. An image forming arrangement comprising:

an image-forming member having an image-receiving surface which is movable in a continuous path;

a plurality of image-forming stations adjacent to the path of motion of the image-receiving surface, each image forming station including an arrangement for producing an electrostatic image on the image-receiving surface and a developing station for applying toner particles which include a ferromagnetic material to an electrostatic image on the image-receiving surface; and a magnetic field generating member providing a magnetic field which tends to retain toner particles containing ferromagnetic material on the image-receiving surface.

2. An image forming arrangement according to claim 1 wherein each developing station includes a developer roll disposed in spaced relation to the image-receiving surface of the image forming member and a DC-biased AC potential source for applying a DC-biased AC potential to the developer roll.

3. An image forming arrangement according to claim 1 wherein the magnetic field generating member comprises a permanent magnet plate extending parallel to the direction of motion of the image-receiving surface on the side of the image forming member opposite from each of the plurality of developing units.

4. An image forming arrangement according to claim 1 wherein the magnetic field generating member comprises permanent magnet material.

5. An image forming arrangement according to claim 1 including a magnetic field generating member adjacent to each of the developing stations.

6. An image-forming arrangement according to claim 1 wherein the image-forming member is a photoreceptor and including a charging unit and an exposing unit at each image-forming station to form an electrostatic image on the image-receiving surface.

7. An image-forming arrangement according to claim 1 wherein the image-forming member is a continuous belt of flexible material driven in an endless loop path and the plurality of image forming stations are disposed in spaced relation along a straight portion of the path.

8. An image forming arrangement according to claim 1 including a transfer station for transferring toner images from the image-receiving surface to a substrate.

9. An image forming arrangement according to claim 1 wherein each developing station contains toner particles having a color different from those of toner particles in the other developing stations.

10. An image forming arrangement according to claim 9 wherein the colors of the different colored toner particles are yellow, magenta, cyan and black.

11. An arrangement for developing electrostatic images on an image receiving surface of an image forming member comprising a plurality of spaced developing stations disposed adjacent to the image-receiving surface of the image forming member, a developer roll at each developing station for supplying toner particles containing ferromagnetic material in closely spaced relation to the image-receiving surface, and a magnet member on the opposite side of the image-forming member at each of the developing stations.

12. An arrangement according to claim 11 including a DC-biased AC voltage source for each developing station applying a DC-biased AC potential to the developer roll at the corresponding developing station.

13. An arrangement according to claim 11 wherein the magnet member comprises permanent magnet material.

14. A method for developing electrostatic images on an image-receiving surface of an image-forming member comprising supplying a toner containing ferromagnetic material to an electrostatic image on the image-receiving surface and providing a magnetic force to hold the toner on the image-receiving surface.

15. A method according to claim 14 including supplying toner containing ferromagnetic material to the image-receiving surface from a developer roll spaced from the image receiving surface and applying a DC-biased AC potential to the developing roll.

16. A method according to claim 14 comprising supplying a first toner containing ferromagnetic material to an image receiving surface to form a first toner image thereon, providing a magnetic force to hold the first toner image on the image-receiving surface, and supplying a second toner to a second electrostatic image on the image receiving surface to form a second toner image thereon while the first toner image is held on the surface by the magnetic force.

* * * * *